United States Patent [19]

Barry

[11] Patent Number: 5,004,134

[45] Date of Patent: Apr. 2, 1991

[54] BACKPACK SYSTEM FOR BEACH RELATED ACTIVITIES

[76] Inventor: Thomas P. Barry, P.O. Box 10591, Marina del Rey, Calif. 90291

[21] Appl. No.: 475,742

[22] Filed: Feb. 6, 1990

[51] Int. Cl.[5] ..... A45F 3/04

[52] U.S. Cl. ..... 224/209; 224/148; 224/210; 224/214; 224/235; 224/261; 224/915

[58] Field of Search ..... 224/148, 209, 210, 211, 224/212, 214, 215, 216, 235, 236, 237, 241, 259, 261, 262, 915

[56] References Cited

U.S. PATENT DOCUMENTS

| | | | |
|---|---|---|---|
| 2,823,971 | 2/1958 | Hoyt | 224/209 |
| 3,622,056 | 11/1971 | Droeger | 224/209 X |
| 3,733,017 | 5/1973 | Pletz | 224/211 |
| 4,648,121 | 3/1987 | Lowe | 224/209 X |

FOREIGN PATENT DOCUMENTS

| | | | |
|---|---|---|---|
| 928117 | 11/1947 | France | 224/209 |
| 2278290 | 3/1976 | France | 224/209 |
| 11757 | 7/1924 | Netherlands | 224/209 |
| 72120 | 10/1915 | Switzerland | 224/209 |
| 90194 | 8/1921 | Switzerland | 224/209 |
| 237539 | 4/1945 | Switzerland | 224/209 |

*Primary Examiner*—Ernest G. Cusick
*Attorney, Agent, or Firm*—Lyon & Lyon

[57] ABSTRACT

A backpack system for personal use in carrying a full day's worth of beach related items. A pliant rectangular shell has adjustable straps for easy carrying capabilities. Numerous external pockets of variable size permit packing of numerous odd-sized items. An umbrella retaining assembly allows the user to carry a beach umbrella for shade purposes and a connector assembly attaches a tubular designed beach chair to the backpack. The shell encloses two individualized cavities to separately carry larger items. A flexible hinge and connection feature allows the user to have easy access to each internal cavity by opening the top cover or the upper portion of the backpack. An ice chest is releasably secured within the lower cavity to carry ice and canned beverages.

6 Claims, 2 Drawing Sheets

BACKPACK SYSTEM FOR BEACH RELATED ACTIVITIES

BACKGROUND OF THE INVENTION

The field of the present invention is backpack systems for personal use in transporting items related to beach activities.

A trip to the beach or similar outdoor area can be ruined because an important item was forgotten when preparing for a day of fun and relaxation. A forgotten beach towel means a day of swimming without being able to dry off. A forgotten beach mat or beach chair means not being able to comfortably lay out or sit out on the hot sand. Without sunscreen and a beach umbrella, one may be subject to the damaging rays of the sun for extended periods of time. If one does remember all of the important items, he or she must make several trips to the car to carry the umbrella, ice chest, and beach chair. This could turn an otherwise enjoyable day of relaxation into a day of constant packing and hauling of items.

Past attempts to use a backpack for carrying beach related items have had substantial drawbacks. The larger backpacks are too heavy and cumbersome, as these were designed to be durable for camping and hiking. Therefore, they do not have a soft outer shell for long wearing comfort and cannot carry the essential beach items such as an ice chest, beach chair and umbrella. The smaller packs cannot carry these larger items and thus, in addition to the pack, one is required to clumsily hand carry his ice chest, beach chair and umbrella. A need has arisen for a lightweight backpack that is designed to carry enough items for a full day of beach going activities.

SUMMARY OF THE INVENTION

The present invention is directed to backpacks for carrying items related to beach going activities. The present invention provides a lightweight backpack for carrying the necessary personal items for a full day of beach activities.

In a first aspect, an exterior shell of substantially rectangular dimensions is provided and is made of a pliant, lightweight cloth material. Adjustable back straps are attached to the shell to allow users of various stature to carry the backpack in a comfortable, upright position. The shell is made of a soft, non-abrasive material for long-wearing comfort. The interior of the shell comprises an internal cavity for carrying the beach related items. An opening is located at the uppermost portion of the shell which can be securely closed by a cover with a closure mechanism located at the perimeter of the opening.

Attached to the shell are numerous exterior pockets. These are made of the same flexible material as the shell and are of variable sizes to conveniently hold bottles of sunscreen, personal house keys and magazines. Each pocket has a separate closure attachment for securely closing the pocket. The backpack can also carry the essential beach umbrella by the added feature of a retaining assembly. This feature is located on a lateral portion of the backpack so as to permit quick packing or unpacking of the umbrella.

Located on the anterior portion of the backpack is the connector assembly. This balanced design allows the user to carry a beach chair constructed of the standard tubular design. A quick release feature allows easy packing and unpacking of the beach chair.

A second aspect of the present invention contemplates the shell being made of a synthetic material.

Another aspect utilizes a cover that comprises a hood that is generally of a barrel-like shape. This hood feature increases the interior volume of the shell to allow additional items to be packed. The hood is attached to the shell by a flexible hinge and a closure mechanism. This hinge allows unencumbered access to the items within the backpack by allowing the hood to rotate away from the shell.

A further aspect contemplates two internal cavities within the shell that are separated by an intermediate panel. This dual storage system allows separate packing of items in the backpack. A second closure mechanism secures the first internal cavity to the second internal cavity for only a partial distance along the perimeter of the shell thus allowing a continuous strip of the shell to act as a hinge. This hinge allows the upper portion of the shell to rotate away from the bottom cavity for easy access to items therein.

Another aspect contemplates a lightweight ice chest, secured within the second internal cavity. This placement in the second internal cavity lowers the center of gravity of the backpack and increases the carrying comfort. A strap on the ice chest allows quick packing and unpacking of the ice chest.

Accordingly, it is an object of the present invention to provide a lightweight backpack system for carrying a full days worth of items related to beach going activities. Other and further objects and advantages will appear hereinafter.

DETAILED DESCRIPTION OF THE PREFERRED EMBODIMENT

Turning in detail to the drawings, a backpack for carrying items related to beach activities is shown. The outer shell !0 is generally rectangular in shape and is of a pliable lightweight material for comfort and stability during use. The shell 10 is attached to a carrying means 12, which is a set of adjustable straps for carrying the backpack in an upright position upon the user's shoulders and back. A top opening 14 is located at the upper portion of the shell 10.

Figure 1:
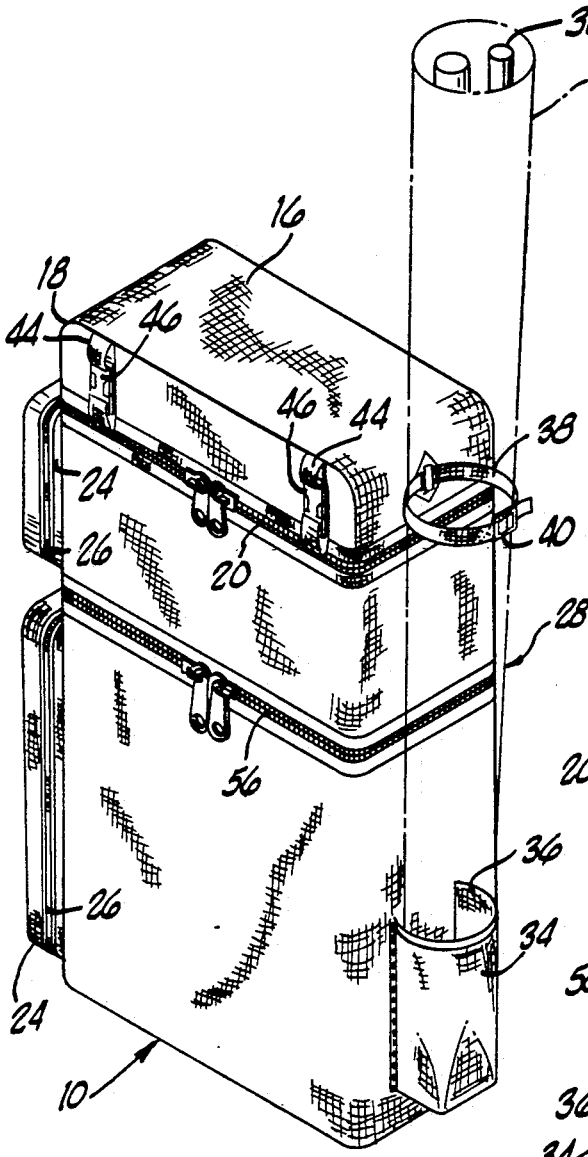
FIG. 1 is an oblique elevation view of the present invention.
Figure 2:
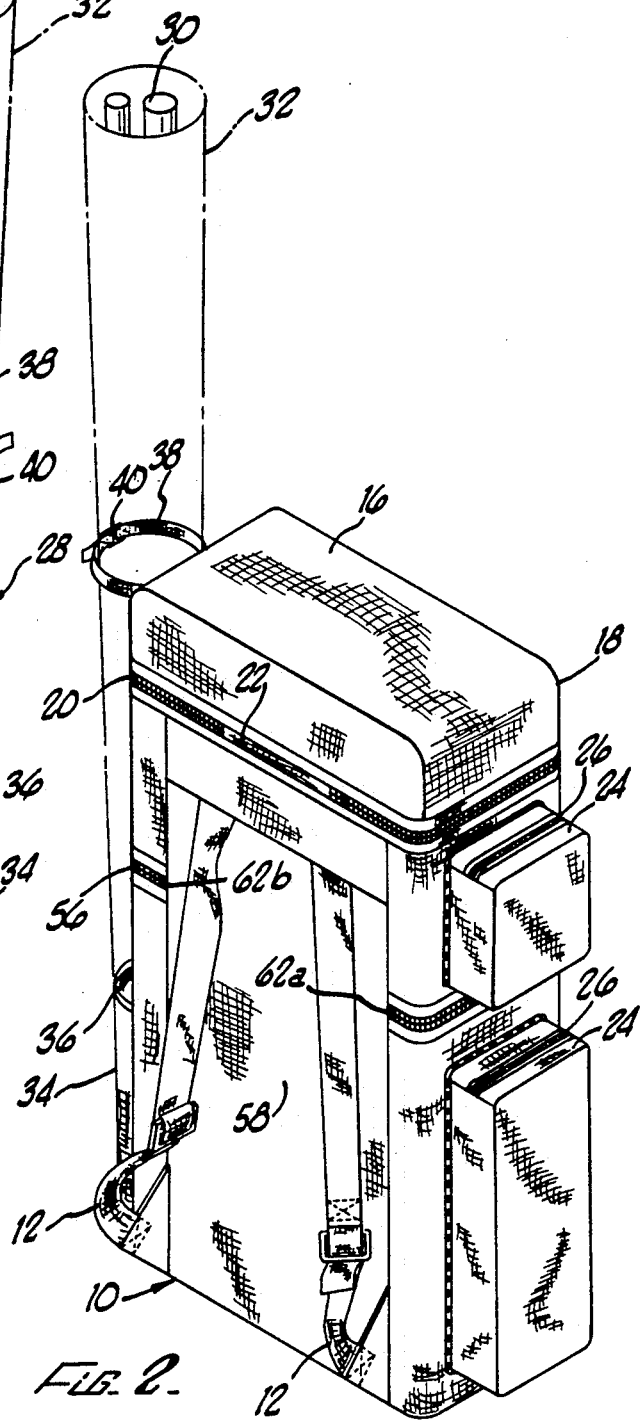
FIG. 2 is an oblique back view of the preferred embodiment of the present invention.
Figure 4:
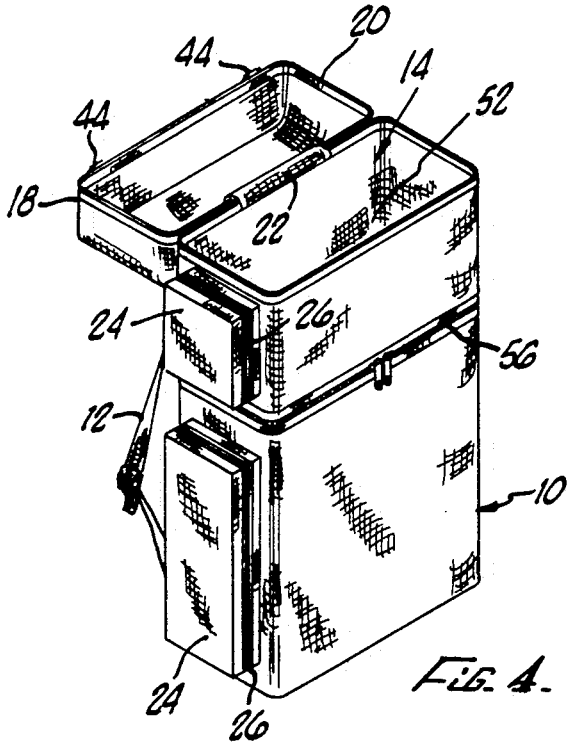
FIG. 4 illustrates the top cover in the preferred embodiment and the attached hinge.

The shell 10 is covered by a top cover 16, which is made of the same material as the shell 10. In the preferred embodiment, the top cover 16 further comprises a hood 18, which is generally barrel-like in configuration as shown in FIGS. 1 and 2. The hood 18 is closed over the top opening 14 by a first closure means 20 which extends around the perimeter of the interface between the shell 10 and hood 18. A first hinge 22 secures the hood 18 to the shell 10 when the first closure means 20 is open. This is illustrated in FIGS. 2 and 4.

A plurality of exterior pockets 24 are attached to the shell 10. In the preferred embodiment, two exterior pockets 24 are shown on a lateral portion of the shell 10 and are of variable dimensions for packing items of different sizes. Each exterior pocket 24 has a pocket closure means 26 for closing each exterior pocket 24 and securing the articles therein.

On one side of the shell 10 is the umbrella retaining assembly, designated generally as 28. This feature secures an umbrella 30, which is enclosed within a sheath 32 to form a substantially cylindrical body, to the shell 10. The umbrella 30 is secured at one end by an external pouch 34 which is attached to the shell 10 and made of the same pliant material. At the upper portion of the external pouch 34 is the first opening 36 which accepts an end portion of the umbrella 30 and provides support thereto. An upper support for the umbrella 30 is provided by the attachment collar 38 which is provided with an adjustable means 40 to secure the umbrella 30 to the shell 10. The attachment collar 38 is secured to the shell 10 in a concentric fashion above the external pouch 34 to provide a parallel support for the umbrella 30.

Figure 3:
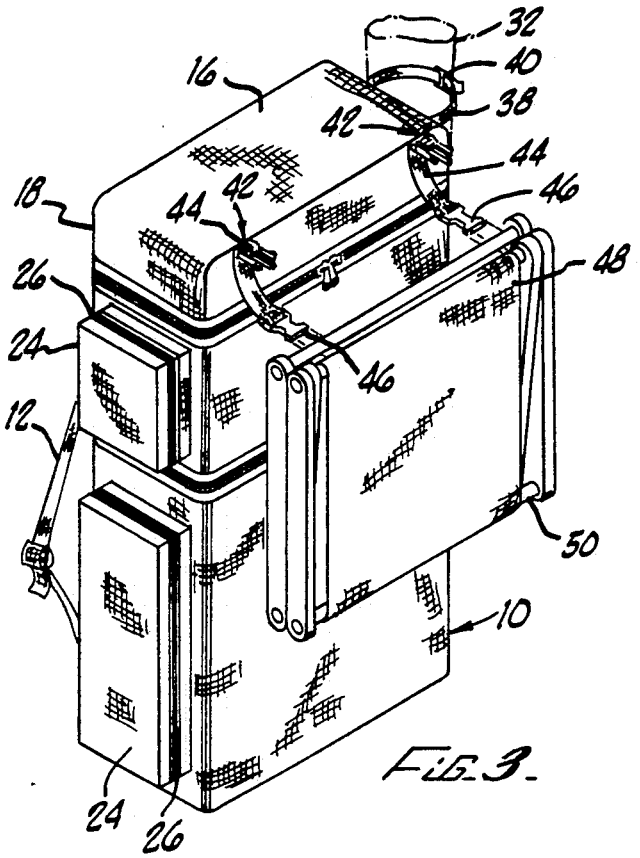
FIG. 3 is an oblique view of the present invention illustrating the use of the beach chair connector assembly.

Attached to the top cover 16 is the connector assembly, designated generally as 42. The preferred embodiment, as shown in FIG. 3, utilizes a pair of connectors 44 attached in a parallel fashion to the hood 18. The connectors 44 have an easy-opener 46 to quickly pack or unpack an item. The design is particularly suited for carrying a beach chair 48 which has a generally tubular construction 50.

Turning to FIG. 4, the hood 18 is swung open by the first hinge 22 to reveal the top opening 14 and the first internal cavity 52. The first internal cavity 52 is defined on four sides by a portion of the shell 10 and on the bottom by an intermediate panel 54. This first internal cavity 52 is convenient for carrying lightweight objects such as a beach mat and a beach towel.

Figure 5:
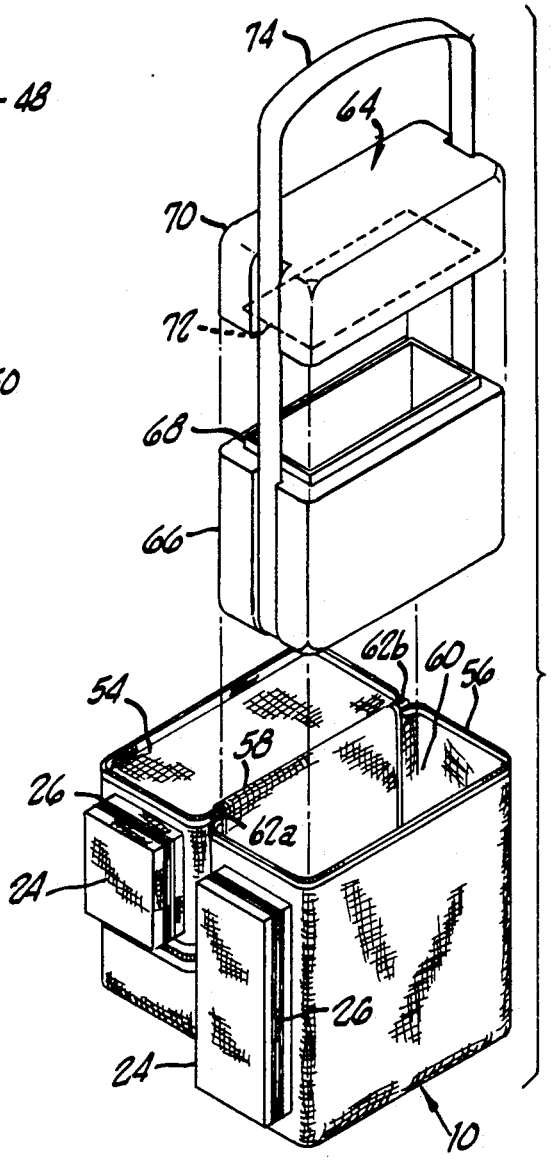
FIG. 5 illustrates the second internal cavity and the position of the ice chest therein.

The first internal cavity 52 is partially secured to the shell 10 by a second closure means 56 and a continuous strip portion 58, made of a continuous portion of the shell 10. This continuous strip portion 58 acts as a hinge to permit the upper portion of the backpack, including the first internal cavity 52, to swing open and allow access to the larger second internal cavity 60. The second closure means 56 terminates at points **62*a* and 62*b* adjacent to the continuous strip portion 58 to securely close the second internal cavity 60. This is illustrated in FIG. 5**.

The second internal cavity 60 may accommodate an ice chest 64 to retain canned beverages and ice. The ice chest 64 is generally rectangular in shape and comprises a body portion 66 having an extended lip 68. A lid 70 engages the body portion 66 at the lip 68 by a groove 72 to securely enclose the items inside. A strap 74 for carrying permits easy packing and unpacking of the ice chest 64.

What is claimed is:

1. A backpack system comprising in combination:

(a) a substantially rectangular pliant cloth shell having four sides and a bottom with a top opening at the upper portion of said shell, said top opening enclosed by a cover, said cover secured to said shell by a first closure means to secure articles within said shell;

(b) a carrying means attached to said shell to secure said shell to the user's shoulders and back in a substantially upright position;

(c) a plurality of exterior pockets of the same material as said shell, and attached to said shell, said exterior pockets each having a pocket closure means for retaining a plurality of objects within said exterior pockets;

(d) an umbrella retaining assembly comprising (i) an umbrella, enclosed within a sheath to form a substantially cylindrical body, (ii) an external pouch attached to said shell and having substantially vertical sides culminating in a first opening, said first opening engaging said umbrella, (iii) an attachment collar, attached to said cover and disposed in combination with and in a substantially concentric manner with said first opening to secure said umbrella to said shell;

(e) a connector assembly, comprising (i) a beach chair of a substantially tubular construction, (ii) a plurality of connectors attached to said cover, each connector having an easy open capability to releasably secure said beach chair to said cover.

2. The backpack system of claim 1 wherein said shell is made of a synthetic material.

3. The backpack system of claim 1 wherein said cover comprises (a) a hood, said hood being made of the same material as said shell and of substantially the same dimensions as said top opening and being generally barrel-like in shape;

(b) a first hinge, attached to said hood and said shell, said first hinge permitting the opening of said hood.

4. A backpack system comprising in combination (a) a substantially rectangular pliant cloth shell having four sides, a bottom and a top opening, and comprising (i) a first internal cavity defined by a portion of the four sides of said shell and an intermediate panel, said intermediate panel attached to said shell, said first internal cavity being enclosed by a hood, said hood being made of the same material as said shell and of substantially the same dimensions as said top opening and being generally barrel-like in shape, said hood attached to said shell by a first hinge and a first closure means for substantially closing said hood over said first internal cavity, (ii) a second internal cavity, contiguous with said first internal cavity and in communication with said intermediate panel, with a second closure means to substantially close said second internal cavity, but said second closure means terminating at a certain point permitting a continuous strip portion of said shell to connect said second internal cavity to said first internal cavity;

(b) a carrying means attached to said shell to secure said shell to the user's shoulders and back in a substantially upright position;

(c) a plurality of exterior pockets of the same material as said shell, and attached to said shell, said exterior pockets each having a pocket closure means for retaining a plurality of objects within said exterior pockets;

(d) an umbrella retaining assembly comprising (i) an umbrella, sheathed to form a substantially cylindrical body;

(ii) an external pouch attached to said shell and having substantially vertical sides culminating in a first opening, said first opening engaging said umbrella;

(iii) an attachment collar, attached to said hood, and disposed in combination with and in a substantially concentric manner with said first opening to secure said umbrella to said shell.

(e) a connector assembly comprising, (i) a beach chair of a substantially tubular construction, and (ii) a plurality of connectors attached to said hood, each connector having an easy open capability to releasably secure said beach chair to said hood;

5. The backpack system of claim 4 wherein said shell is made of a synthetic material.

6. The backpack system of claim 4 further comprising an ice chest, releasably secured within said second internal cavity and comprising:

a substantially rectangular body of lightweight insulation material having four sides and a bottom and an upper opening with a lip projecting vertically upward from the perimeter of said opening;

a lid, made of the same material as said body, and substantially rectangular in shape and of the same dimension as the opening of said body, said lid having an inwardly extending groove of substantially the same dimensions as said lip on said body;

a strap, attached to said body and contiguous with said lid.

* * * * *